US007024132B2

(12) United States Patent
Nakaoka et al.

(10) Patent No.: US 7,024,132 B2
(45) Date of Patent: Apr. 4, 2006

(54) IMAGE FORMING APPARATUS WITH SUBSTANTIALLY HORIZONTAL TRANSPORT PATHS

(75) Inventors: Takeshi Nakaoka, Kashiwazaki (JP); Noribumi Sato, Iwatsuki (JP); Akihito Yamauchi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/868,940

(22) Filed: Jun. 17, 2004

(65) Prior Publication Data

US 2005/0084306 A1 Apr. 21, 2005

(30) Foreign Application Priority Data

Oct. 16, 2003 (JP) ..... 2003-356174

(51) Int. Cl.
*G03G 15/00* (2006.01)

(52) U.S. Cl. ..... 399/110

(58) Field of Classification Search ..... 399/401, 399/110, 111

See application file for complete search history.

(56) References Cited

U.S. PATENT DOCUMENTS

| | | | | |
|---|---|---|---|---|
| 4,436,409 | A * | 3/1984 | Queener | 399/194 |
| 5,666,629 | A * | 9/1997 | Kazoh | 399/401 |
| 5,799,236 | A * | 8/1998 | Paczkowski | 399/309 |
| 5,839,016 | A * | 11/1998 | Folkins et al. | 399/46 |
| 6,385,431 | B1 * | 5/2002 | Arcaro et al. | 399/381 |

FOREIGN PATENT DOCUMENTS

JP A-2001-331080 11/2001

* cited by examiner

*Primary Examiner*—Quana Grainger
(74) *Attorney, Agent, or Firm*—Morgan Lewis & Bockius LLP

(57) ABSTRACT

An image forming apparatus includes an image forming part, a transport part transporting a record medium to the image forming part and having a substantially horizontal portion, and a reverse path disposed above the transport part, having a substantially horizontal portion and adapted to reverse and return the record medium to an upstream side of the image forming part in the transport path.

8 Claims, 5 Drawing Sheets

IMAGE FORMING APPARATUS WITH SUBSTANTIALLY HORIZONTAL TRANSPORT PATHS

BACKGROUND OF THE INVENTION

1. Field of the Invention

This invention relates to an image forming apparatus such as a printer, a copying machine or a facsimile.

2. Description of the Related Arts

In a known image forming apparatus, a latent image written to an image bearing member is developed into a toner image by a developing device using four colors, yellow, magenta, cyan and black. In this type of image forming apparatus, it is publicly known that a record medium is transported in the substantially horizontal direction to form an image (See Patent Reference 1).

[Patent Reference 1]

Japanese Published Unexamined Patent Application No. 2001-331080

In the above related art, however, the record medium cannot be reversed, so both-sided printing is not performed.

SUMMARY OF THE INVENTION

The present invention has been made in view of the above circumstances and provides an image forming apparatus, which may perform both-sided printing while a record medium is transported in the substantially horizontal direction to form an image.

According to an aspect of the present invention, the image forming apparatus includes an image forming part, a transport path transporting a record medium to the image forming part and having a substantially horizontal portion, and a reversing path disposed above the transport path, having a substantially horizontal portion and adapted to reverse and return the record medium to an upstream side of the image forming part in the transport path. Thus, even if the record medium is transported in the substantially horizontal direction to form an image, both-sided printing can be performed.

BRIEF DESCRIPTION OF THE DRAWINGS

Preferred embodiments of the present invention will be described in detail based on the following figures, wherein.

DESCRIPTION OF THE PREFERRED EMBODIMENTS

A first embodiment of the invention will now be described with reference to the attached drawings.

Figure 1:
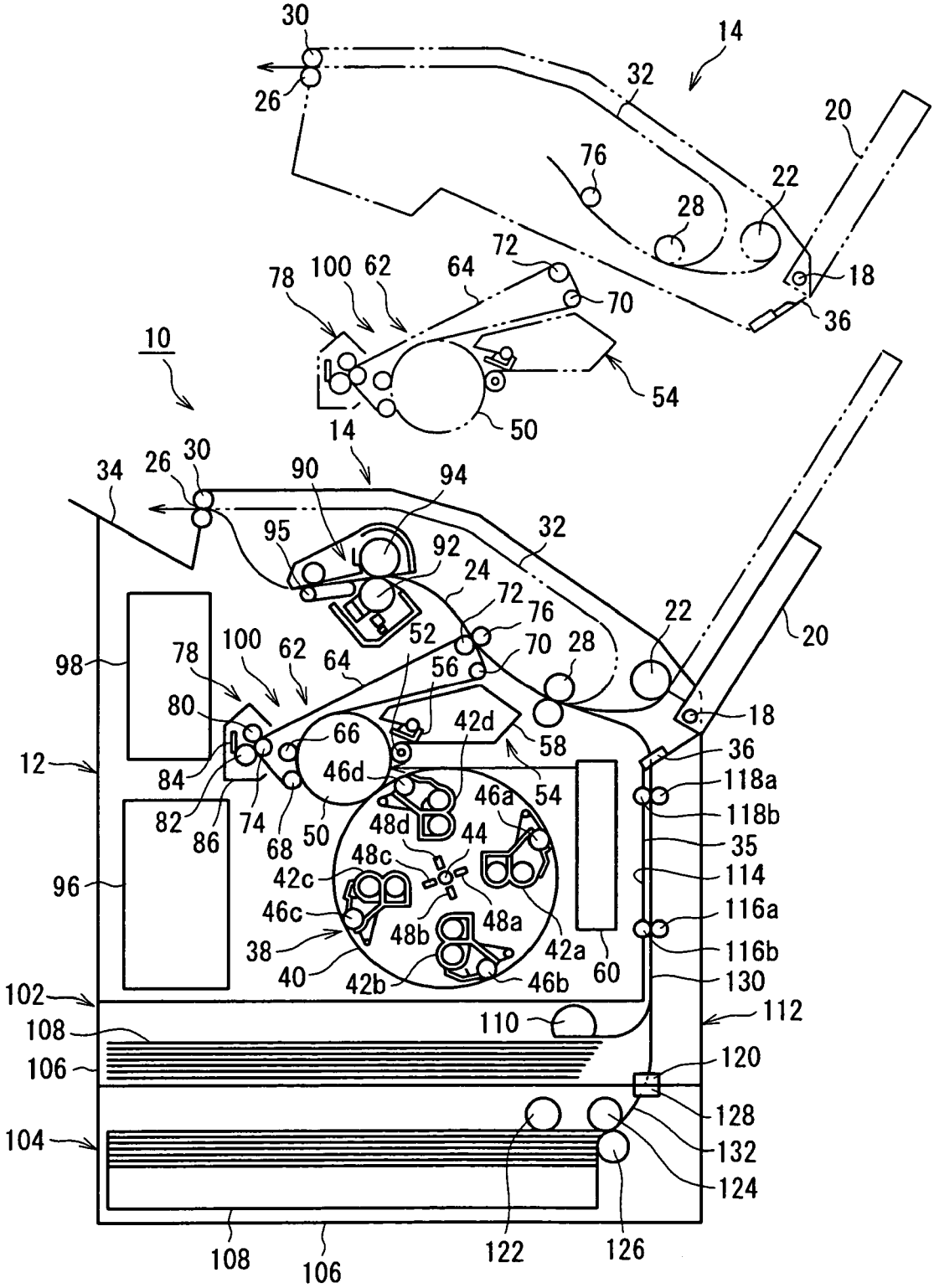
FIG. 1 is a side view showing an image forming apparatus according to a first embodiment of the invention.

FIG. 1 shows the outline of an image forming apparatus 10 according to a first embodiment of the invention. The image forming apparatus 10 has an image forming apparatus body 12, and a reversing transport unit 14 having a discharging reverse roll 30 and a second transport path 32 mentioned later is removably provided on the upper part of the image forming apparatus body 12. The front side (the right in FIG. 1) of the reversing transport unit 14 is provided with a first record medium feeder 20 such as a manual feed tray freely turned on a rotational fulcrum 18. The first record medium feeder 20 is disposed above a rotary developing device 38, an image bearing member 50 and an intermediate transfer device 62 with a gradient ranging from 45 degrees to 75 degrees to the horizontal direction. A pickup roll 22 for feeding a record medium is disposed on the reversing transport unit 14 side of the first record medium feeder 20.

A first transport path 24 is formed in the upper portion of the image forming apparatus body 12 by fitting the reversing transport unit 14 to the image forming apparatus body 12. The first transport path 24 is a record medium passage extending from the pickup roll 22 to a discharge port 26, and formed substantially horizontal from the first recording medium feeder 20 to the discharge port 26. The first transport path 24 passes the interior of a fixing device 90 mentioned later, and a secondary transfer roll 76 and a secondary transfer backup roll 72 mentioned later are disposed on the upstream side of the fixing device 90. A register roll 28 is disposed on the upstream side of the secondary transfer roll 76 and the secondary transfer backup roll 72. A discharging reverse roll 30 is disposed in the vicinity of the discharge port 26 of the first transport path 24. The discharging reverse roll 30 is rotated normally and reversed by a reversing motor not shown. On the upper side of the first transport path 24, a second transport path 32 as a record medium passage from the discharging reverse roll 30 to the register roll 28 is provided substantially horizontally to the first transport path 24.

Accordingly, in the case of one-sided printing, the record media are delivered from the first record medium feeder 20 by the pickup roll 22, and only the uppermost record medium is guided to the first transport path 24, temporarily stopped by the register roll 28, and passed between the secondary transfer roll 76 and the secondary transfer backup roll 72 to transfer a toner image at a timing. The transferred toner image is fixed on the record medium by the fixing device 90, and then the record medium is discharged to a discharge part 34 by the discharging reverse roll 30. The discharge part 34 is made lower in a discharge port area, and inclined to be gradually increased in height as it goes toward the back side (to the left in FIG. 1).

In the case of both-sided printing, the record medium guided to the discharging reverse roll 30 is delivered to the back of the image forming apparatus 10 by the discharge reversing roll 30 until the trailing end of the record medium is delivered from the fixing device 90, and when the trailing end of the record medium is delivered from the fixing device 90, the discharging reverse roll 30 is reversed to guide the record medium toward the second transport path 32. The record medium guided to the second transport path 32 is again returned to the register roll 28 through the transport roll not shown. The record medium is temporarily stopped by the register roll 28 to transfer a toner image at a timing. The transferred toner image is fixed on the record medium by the fixing device 90, and the record medium is discharge to the discharge part 34 by normal rotation of the discharging reverse roll 30.

The image forming apparatus body 12 is provided with a removable front cover (not shown) at the lower portion of the front side (left side in FIG. 1), and the front cover is detached to expose the body front 35 of the image forming apparatus body 12 and a record medium passing port 36 for passing the record medium, to which a second record medium feeder 102 as an option mentioned later is fitted.

The rotary developing device 38 is disposed in the substantially central lower part in the image forming apparatus body 12. The rotary developing device 38 is provided with developing units 42*a* to 42*d* respectively forming toner images of four colors, yellow, magenta, cyan and black in the developing device body 40, and rotated left-handed (counterclockwise in FIG. 1) around the center 44 of the rotary developing device. The developing units 42*a* to 42*d* are respectively provided with developing rolls 46*a* to 46*d*, which are pressed in the normal direction of the developing device body 40 by elastic bodies 48*a* to 48*d* such as coil springs.

An image bearing member 50 constituted of a photoreceptor is disposed to abut on the rotary developing device 38, and the developing rolls 46*a* to 46*d* are in the state of not abutting on the image bearing member 50 with a part of each outer periphery thereof projected 2 mm in the radial direction from the outer periphery of the developing device body 40. At both ends of the developing rolls 46*a* to 46*d*, tracking rolls (not shown) having a diameter slightly larger than the diameters of the developing rolls 46*a* to 46*d* are provided to rotate coaxially with the developing rolls 46*a* to 46*d*. That is, the developing rolls 46*a* to 46*d* of the developing units 42*a* to 42*d* are disposed at intervals of 90 degrees around the center 44 of the rotary developing device in the outer periphery of the developing device body 40, and the tracking rolls of the developing rolls 46*a* to 46*d* are abutted on the flanges (not shown) provided on both ends of the image bearing member 50, thereby forming a designated clearance gap between the developing rolls 46*a* to 46*d* and the image bearing member 50 and simultaneously developing latent images on the image bearing member 50 with toner of the respective colors.

A charging device 52 constituted of a charging roll and the like for uniformly charging the image bearing member 50 is provided on the front side (on the right in FIG. 1) of the image bearing member 50. An image bearing member cleaner 54 is abutted on the image bearing member 50 on the upstream side of the charging device 52 in the rotating direction of the image bearing member 50. The image bearing member cleaner 54 is constituted of a cleaning blade 56 for scraping off toner remaining on the image bearing member 50 after the primary transfer and a toner collecting bottle 58 for collecting the toner scraped off by the cleaning blade 56.

A rib and the like is formed on the upper side of the front of the toner collecting bottle 58 to be like a curved surface so that the record medium is smoothly transported, which constitutes the first transport path 24.

An exposure device 60 for writing a latent image to the image baring member 50 charged by the charging device 52 with beams of light such as laser beams is disposed on the front side (on the right in FIG. 1) of the rotary developing device 38. On the upper side of the rotary developing device 38, the intermediate transfer device 62 is provided, in which the toner image developed into a visible image by the rotary developing device 38 is primary-transferred to the record medium in the primary transfer position and transported to a secondary transfer position mentioned later.

The intermediate transfer device 62 is formed of an intermediate transfer body 64 such as an intermediate transfer belt, a primary transfer roll 66, a wrap-in roll 68, a wrap-out roll 70, a secondary transfer backup roll 72 and a belt cleaner backup roll 74. The intermediate transfer body 64 has elasticity and is stretched substantially flat to have long sides and short sides on the image bearing body 50.

The intermediate transfer body 64 has an image bearing member wrapping area abutting on the image bearing member 50 in the wrapping state between the wrap-in roll 68 disposed upstream from the primary transfer roll 66 below the long side of the intermediate transfer body 64 and the wrap-out roll 70 disposed downstream from the primary transfer roll 66, whereby the intermediate transfer body 64 is wrapped round the image bearing member 50 in a designated range to follow the rotation of the image bearing member 50. Thus, the intermediate transfer body 64 is subjected to the primary transfer by the primary transfer roll 66 to thereby superpose toner images on the image bearing member 50 in the order of yellow, magenta, cyan and black, and the primary-transferred toner images are transported toward the secondary transfer roll 76 mentioned later.

The wrap-in roll 68 and the wrap-out roll 70 are separated from the image bearing member 50.

Further, on the front side (on the right side in FIG. 1) of the intermediate transfer body 64, a flat surface part (short side) is formed by the wrap-out roll 70 and the secondary transfer backup roll 72, and the flat surface part is served as a secondary transfer part, facing on the first transport path 24.

In the secondary transfer part, the wrap-out roll 70 is disposed so that the intermediate transfer body 64 and the first transport path 24 make an angle of 12? between them.

The secondary transfer roll 76 is disposed opposite to the secondary transfer backup roll 72 of the intermediate transfer device 62 with the first transport path 24 interposed between the rolls. That is, the space between the secondary transfer roll 76 and the secondary transfer backup roll 72 is used as the secondary transfer position in the secondary transfer part, and the secondary transfer roll 76 is adapted to secondary-transfer the toner image primary-transferred to the intermediate transfer body 64 to the record medium in the secondary transfer position by assistance of the secondary transfer backup roll 72. In this case, the secondary transfer roll 76 is separated from the intermediate transfer body 64 while the intermediate transfer body 64 make three rotations, that is, the toner images of three colors, yellow, magenta and cyan are transported, and the moment the toner image of black is transferred, it abuts on the intermediate transfer body 64. A designated potential difference is produced between the secondary transfer roll 76 and the secondary transfer backup roll 72, so that in the case where the secondary transfer roll 76 is operated at high voltage, the secondary transfer backup roll 72 is connected to the ground (GND) and the like.

The belt cleaner backup roll 74 assists with transferring the toner remaining on the intermediate transfer body 64 after the secondary transfer to a belt cleaner roll 82 mentioned later.

An intermediate transfer body cleaner 78 abuts on the counter-secondary transfer position side of the intermediate transfer device 62. The intermediate transfer body cleaner 78 is, for example, constituted of a brush roll 80 for scraping off toner remaining on the intermediate transfer body 64 after the secondary transfer, the belt cleaner roll 82 for further transferring the remaining toner after scraping off by the brush roll 80 to clean the transfer body, a scraper 84 for scraping off the toner transferred to the belt cleaner roll 82, and a toner collecting bottle 86 for collecting the scraped toner. While the intermediate transfer body 64 transports the toner image, the intermediate transfer body cleaner 78 is separated from the intermediate transfer body 64, and at a designated timing, they are united in a body to abut on the intermediate transfer body 64.

The fixing device 90 is disposed downstream from the secondary transfer position. The fixing device 90 is provided with a heat roll 92, a pressure roll 94 and a fixing device discharge roll 95, and adapted to fix a toner image secondary-transferred by the secondary transfer roll 76 and secondary transfer backup roll 72 to a record medium to the record medium. The record medium is discharged from the fixing device 90 by the fixing device discharge roll 95.

A power supply part 96 is disposed on the back (on the left in FIG. 1) of the image forming apparatus body 12 and adapted to supply the power to the respective components constituting the image forming apparatus 10. A control part 98 for controlling the respective components constituting the image forming apparatus 10 is disposed above the power supply part 96.

An image forming unit 100 is constructed by uniting the intermediate transfer device 62, the image bearing member 50, the charging device 52, the image bearing member cleaner 54 and the intermediate transfer body cleaner 78 into one body. The image forming unit 100 is disposed below the fixing device 90, the intermediate transfer device 62 and the image bearing member 50 are disposed between the rotary developing device 38 and the fixing device 90, and when the reversing transport unit 14 is removed, the unit is attached and detached to and from the upper side of the image forming apparatus body 12.

A second record medium feeder 102 and a third record medium feeder 104 as an option and an image forming apparatus 10 fitted with the feeders will now be described.

The second record medium feeder 102 includes a record medium feeder body 106, a record medium feed cassette 108 storing the record medium, and a unit transport guide part 112 mentioned later, which are unitized. A pickup roll 110 for feeding a record medium from the record medium feed cassette 108 is disposed on the upper part of the vicinity of the innermost end of the record medium feed cassette 108 of the second record medium feeder 102. The unit transport guide part 112 is provided substantially vertically on the innermost recess (on the right in FIG. 1) of the pickup roll 110.

A unit guide 114 formed like a rib is exposed to the inside surface (on the left side in FIG. 1) of the unit transport guide part 112, and provided with transport rolls 116*a*, 118*a*. The transport rolls 116*a*, 1181 are respectively rotated with transport rolls 116*b*, 118*b* mentioned later to thereby transport the record medium from the lower side to the upper side. The lower surface of the second record medium feeder 102 is provided with a record medium passing port 120 for passing the record medium under the transport rolls 116*a*, 118*a*.

The third record medium feeder 104 includes a record medium feeder body 106 and a record medium feed cassette 108 storing the record medium, and the third record medium feeder 104 and the second record medium feeder 102 are freely attached and detached to and from each other. A pickup roll 122 for feeding a record medium from the record medium feed cassette 108 is disposed on the upper side of the innermost recess of the record medium feed cassette 108 of the third record medium feeder 104, and a feed roll 124 and a retard roll 126 for separating the fed record media one by one are disposed on the upper side of the vicinity of the innermost end of the record medium feed cassette 108. A record medium passing port 128 for passing the record medium is provided in the upper surface of the third record medium feeder 104 in the vicinity of the feed roll 124 and the retard roll 126.

The second record medium feeder 102, the third record medium feeder 104 and the image forming apparatus 12 may be integrated with each other.

When the front cover (not shown) is removed from the image forming apparatus body 12, the front 35 of the body formed like a rib, for example, and a record medium passing port 36 disposed above the front 35 of the body are exposed. The transport rolls 116*b*, 118*b* are rotatably fitted to the front 35 of the body. The second record medium feeder 102 and the third record medium feeder 104 are respectively superimposed one over the other with the respective record medium passing ports 120, 128 opposite to each other, and installed so that the upper surface of the second record medium feeder 102 abuts on the lower surface of the image forming apparatus body 12. When the second record medium feeder 102 and the third record medium feeder 104 are installed on the lower side of the image forming apparatus body 12, the unit guide 114 of the second record medium feeder 102 is opposite to the front 35 of the body. The transport rolls 116*a*, 118*a* are respectively brought into contact with the transport rolls 116*b*, 118*b* mounted on the front 35 of the body.

Accordingly, when the second record medium feeder 102 is fitted to the image forming apparatus body 12, the front 35 of the body and the unit guide 114 serve as a guide for guiding a record medium, thereby constituting a third transport path 130 for transporting the record medium in the vertical direction from the pickup roll 110 to the record medium passing port 36 by the transport rolls 116*a*, 116*b*, 118*a*, 118*b*, and bending the same to be transported to the register roll 28. The second record medium feeder 102 and the third record medium feeder 104 are installed by superimposing one over the other with the record medium passing ports 120, 128 opposite to each other, thereby forming a fourth transport path 132 for transporting the record medium from the third record medium feeder 104 to the third transport path 130. That is, the record medium delivered from the third record medium feeder 104 through the fourth transport path 132 is guided to the third transport path 130. The exposure device 60 is disposed substantially vertically to the front side (on the right in FIG. 1) of the rotary developing device 38 as described above, and provided substantially parallel to the unit transport guide part 112 between the image bearing member 50 and the unit transport guide part 112.

Thus, the image bearing member 50, the rotary developing device 38 and the image forming unit 100 are stored in the image forming apparatus body 12 including the front 35 of the body, whereby the record media stored in the second record medium feeder 102 and the third record medium feeder 104 are shielded from the image bearing member 50, the rotary developing device 38 and the image forming unit 100 not to be contaminated by scattering toner until the record medium is transported and passed through the record medium passing port 36.

The operation of the image forming apparatus 10 according to the first embodiment, which is fitted with the second record medium feeder 102 and the third record medium feeder 104, will now be described.

When an image forming signal is transmitted from the control part 98, the image bearing member 50 is uniformly charged by the charging device 52, and beams of light are emitted from the exposure device 60 to the charge image bearing member 50 according to the image signal. The beams of light from the exposure device 60 are applied to the surface of the image bearing member 50 to thereby form a latent image. The latent image of the image bearing member 50 formed by the exposure device 60 is developed into toner images of yellow, magenta, cyan and black by the rotary developing device 38, which are primary-transferred on the intermediate transfer body 64 by superimposing. In the primary transfer, waste toner remaining on the image bearing member 50 is scraped off by the image bearing member cleaner 54 and collected.

On the other hand, in the case where a feed of a record medium from the first record medium feeder 20 is selected by the control part 98, the record medium stored in the first record medium feeder 20 is delivered by the pickup roll 22, guided to the first transport path 24, and temporarily stopped by the register roll 28 to be guided between the secondary transfer roll 76 and the secondary transfer backup roll 72 at a timing.

On the other hand, in the case where a feed of a record medium from one of the second record medium feeder 102 and the third record medium feeder 104 is selected by the control part 98, the record medium stored in the second record medium feeder 102 or the third record medium feeder 104 is guided to the third transport path 130 and temporarily stopped by the register roll 28 to be guided to the secondary transfer roll 76 and the secondary transfer backup roll 72 at a timing.

When the record medium is guided between the secondary transfer roll 76 and the secondary transfer backup roll 72, the toner image primary-transferred to the intermediate transfer body 64 is secondary-transferred to the record medium by the secondary transfer roll 76 and the secondary transfer backup roll 72. After the secondary transfer, the waste toner remaining on the intermediate transfer body 64 is scraped off by the intermediate transfer body cleaner 78 and collected. The record medium to which the toner image is transferred is guided to the fixing device 90, and the toner image is fixed by hot pressure of the heat roll 92 and the pressure roll 94. The record medium on which the toner is fixed is discharged to the discharge part 34 by the discharging reverse roll 30.

On the other hand, in the case of both-sided printing, the record medium guided to the discharging reverse roll 30 is delivered to the back of the image forming apparatus 10 by the discharging reverse roll 30 until the trailing end of the record medium is delivered from the fixing device 90, and when the trailing end of the record medium is delivered from the fixing device 90, the discharging reverse roll 30 is reversed to guide the record medium toward the second transport path 32. The record medium guided to the second transport path 32 is again returned to the register roll 28 through the transport rolls (not shown). The record medium is temporarily stopped by the register roll 28 to transfer the toner image at a timing, and the transferred toner image is fixed by the fixing device 90. The record medium is discharged to the discharge part 34 by normal rotation of the discharging reverse roll 30.

The method of attaching and detaching the image forming unit 100 will now be described.

When the reversing transport unit 14 is detached, the discharging reverse roll 30, the first record medium feeder 20, the pickup roll 22 and the secondary transfer roll 76 are moved with the reversing transport unit 14, and the opening part of the top side of the image forming apparatus body 12 is opened. The image forming unit 100 is detached upward between the fixing device 90 fixed on the upper part of the image forming apparatus body 12 and the rotary developing device 38 through the opening part. Further jam clearing for the record medium and replacement of the developing units 42*a* to 42*d* can be performed through the opening part.

A second embodiment of the invention will now be described with reference to the attached drawings.

Figure 2:
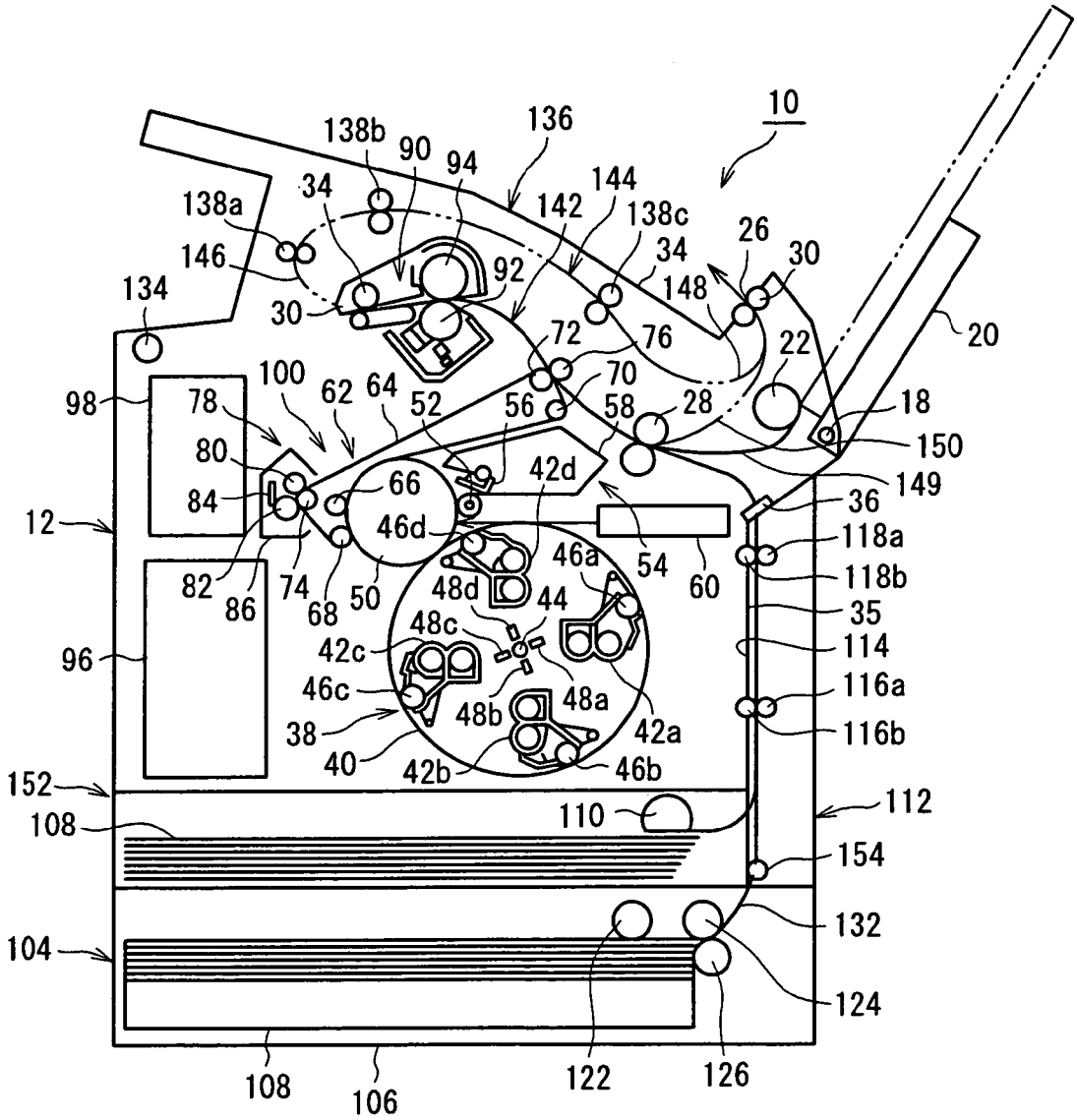
FIG. 2 is a side view showing an image forming apparatus according to a second embodiment of the invention.

FIG. 2 shows the second embodiment of the invention.

In the second embodiment of the invention, the substantially same parts as those of the first embodiment of the invention are designated by the same reference numerals.

According to the second embodiment of the invention, an opening and closing part 136 freely turned on a rotational fulcrum 134 is provided on the upper part of an image forming apparatus body 12. The opening and closing part 136 includes a discharging reverse roll 30 and transport rolls 138*a* to 138*c*, and a discharging part 34 is formed on the upper part thereof. Further, a first record medium feeder 20 such as a manual feed tray freely turned on a rotational fulcrum 18 is provided on the counter-rotational fulcrum side of the opening and closing part 136. A pickup roll 22 for feeding a record medium from the first record medium feeder 20 is disposed on the opening and closing part 136 side of the first record medium feeder 20.

The opening and closing part 136 may be removably attached to the image forming apparatus body 12.

A first transport path 142 has a substantially vertical part and a substantially horizontal part, and the substantially horizontal portion is formed by the opening and closing part 136 and the image forming apparatus body 12. The substantially vertical part of the first transport path 142 is formed by a second record medium feeder 152 mentioned later and the image forming apparatus body 12. The first transport path 142 is a record medium passage extended to a fixing device 90 disposed on the back (on the left in FIG. 2) of the substantially horizontal portion, and a secondary transfer roll 76 and a secondary transfer backup roll 72 are disposed on the upstream side of a fixing device 90. A register roll 28 is disposed on the upstream side of the secondary transfer roll 76 and the secondary transfer backup roll 72.

A second transport path 144 is disposed above the substantially horizontal portion of the first transport path 142, and provided with a substantially horizontal portion. A first U-turn part 146 is provided between the first transport path 142 and the second transport path 144, whereby when the record medium is transported to the back (the left in FIG. 1) of the image forming apparatus 10 through the first transport path 142, it is caused to turn back by the first U-turn part 146, and transported toward the front of the image forming apparatus 10. A second U-turn part 148 is provided between the second transport path 144 and the discharge part 34 disposed on the upper side of the second transport path 144. The transport rolls 138*a* to 138*c* are provided along the first U-turn part 146 and the second transport path 144, and a record medium is transported from the first U-turn part 146 through the second transport path 144 to the second U-turn part 148. Thus, when the record medium is transported toward the front of the image forming apparatus 10 through the second transport path 144 by the transport rolls 138*a* to 138*c*, the record medium is caused to turn back by the second U-turn part 148, and discharged to the discharge part 34 formed on the upper portion of the opening and closing part 136 from a discharge port 26 by the discharging reverse roll 30.

A third transport path 149 is a record medium passage extending from a pickup roll 18 to the register roll 28, and the first record medium feeder 20 is connected to the upstream side of the substantially horizontal portion of the first transport path 142 through the third transport path 149.

A reverse path 150 is a record medium passage extending from the discharging reverse roll 30 to the register roll 28, and the record medium is guided to the register roll 28 by reversion of the discharging reverse roll 30.

Accordingly, in the case of one-sided printing, the record media are delivered from the first record medium feeder 20 by the pickup roll 22, and only the uppermost record medium is guided to the first transport path 142 through the third transport path 149, temporarily stopped by the register roll 28, and passed between the secondary transfer roll 76 and the secondary transfer backup roll 72 at a timing to transfer a toner image. The transferred toner image is fixed by a fixing device 90. The record medium on which a toner image is fixed is caused to turn back by the first U-turn part 146, and when the record medium is transported toward the front of the image forming apparatus 10 through the second transport path 144 by the transport rolls 138*a* to 138*c*, it is caused to again turn back by the second U-turn part 148 and discharged to the discharge part 34 by the discharging reverse roll 30.

In the case of both-sided printing, the record medium guided to the discharging reverse roll 30 is again returned to the upstream side of the substantially horizontal part of the first transport path 142 through a reverse path 150 by reversion of the discharging reverse roll 30 and guided to the register roll 28. The record medium is temporarily stopped by the register roll 28 at a timing to transfer a toner image, and the transferred toner image is fixed by the fixing device 90. The record medium is guided to the discharging reverse roll 30 through the second transport path 144 and discharged to the discharge part 34 by normal rotation of the discharging reverse roll 30.

In the second embodiment, the image forming apparatus 12 is provided with a removable front cover (not shown) mounted on the lower part of the front (on the right in FIG. 2), whereby when the front cover is removed, the body front 35 of the image forming apparatus body 12 and the record medium passing port 36 for passing the record medium are exposed to fit a second record medium feeder 152 and the like as an option mentioned later. The exposure device 60 is disposed substantially horizontally above a rotary developing device 38 to expose the surface of the image bearing member 50.

In the second record medium feeder 152 as an option, a unit transport guide part 112 freely turns on a rotational fulcrum 154. The substantially vertical part 110 of the first transport path 142 transports the record medium from a pickup roll 110 to the record medium passing port 36 by transport rolls 116*a*, 116*b*, 118*a*, 118*b* and guides the same toward the register roll 28.

The operation of the image forming apparatus 10 fitted with the second record medium feeder 152 and a third record medium feeder 104 will now be described.

When an image forming signal is transmitted from a control part 98, an image bearing member 50 is uniformly charged by a charging device 52, and beams are emitted from the exposure device 60 to the charged image bearing member 50 according to the an image signal. The beams from the exposure device 60 are applied to the surface of the image bearing member 50 to thereby form a latent image. The latent image on the image bearing member 50 formed by the exposure device 60 is developed into toner images of yellow, magenta, cyan and black by the rotary developing device 38, which are superimposed and primary-transferred to the intermediate transfer body 64. In the primary transfer, the waste toner remaining on the image bearing member 50 is scraped off by an image bearing member cleaner 54 and collected.

On the other hand, in the case where the feed of a record medium from the first record medium feeder 20 is selected by the control part 98, the record medium stored in the first record medium feeder 20 is delivered by the pickup roll 22, guided to the first transport path 142 through the third transport path 149, and temporarily stopped by the register roll 28 to be guided between the secondary transfer roll 76 and the secondary transfer, backup roll 72 at a timing.

On the other hand, in the case where the feed of a record medium from one of the second record medium feeder 152 and the third record medium feeder 104 is selected by the control part 98, the record medium stored in one of the second record medium feeder 152 and the third record medium feeder 104 is guided to the substantially vertical part of the first transport path 142. The record medium guided to the substantially vertical portion of the first transport path 142 is temporarily stopped by the register roll 28 and guided between the secondary transfer roll 76 and the secondary transfer backup roll 72 at a timing.

When the record medium is guided between the secondary transfer roll 76 and the secondary transfer backup roll 72, the toner image primary-transferred to the intermediate transfer body 64 is secondary-transferred to the record medium by the secondary transfer roll 76 and the secondary transfer backup roll 72. After the secondary transfer, the waste toner remaining on the intermediate transfer body 64 is scraped off by the intermediate transfer body cleaner 78 and collected. The record medium to which the toner image is transferred is guided to the fixing device 90, and the toner image is fixed by hot pressure of a heat roll 92 and a pressure roll 94. When the record medium where the toner image is fixed is caused to turn back by the first U-turn part 146 and transported toward the front of the image forming apparatus 10 through the second transport path 144 by the transport rolls 138*a* to 138*c*, the record medium is caused to again turn back by the second U-turn part 48, and discharged to the discharge part 34 by the discharging reverse roll 30.

In the case of both-sided printing, the record medium guided by the discharging reverse roll 30 is again returned to the register roll 28 of the first transport path 142 through the reverse path 150 by reversion of the discharging reverse roll 30. The record medium is temporarily stopped by the register roll 28 at a timing to transfer the toner image, the transferred toner image is fixed by the fixing device 90, and the record medium is guided to the discharging reverse roll 30 through the second transport path 144. The record medium is discharged to the discharge part 34 by normal rotation of the discharging reverse roll 30.

The method of attaching and detaching the image forming unit 100 and the developing units 42*a* to 42*d* will now be described.

Figure 3:
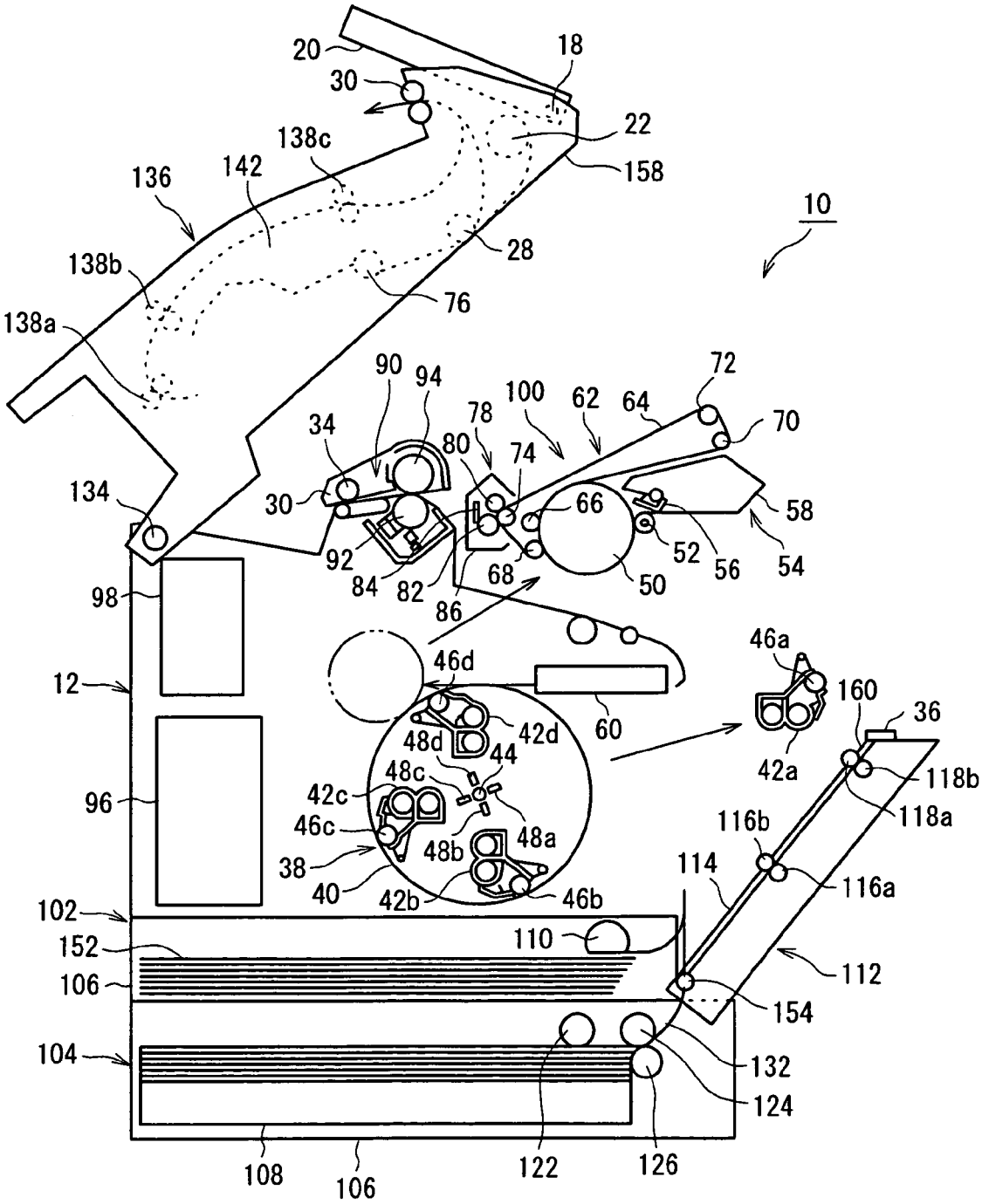
FIG. 3 is a side view showing the condition where an image forming unit and a developing device are detached from the second embodiment of the image forming apparatus according to the invention.

FIG. 3 shows the condition where the image forming unit 100 and the developing unit 42*a* are removed from the second embodiment of the image forming apparatus 10 according to the invention. When the opening and closing part 136 is turned on the rotational fulcrum 134 and opened, the discharging reverse roll 30, the first record medium feeder 20, the pickup roll 22, the secondary transfer roll 76 and the transport rolls 138*a* to 138*c* are moved with the opening and closing part 136, thereby opening the opening part 158 of the upper part of the image forming apparatus body 12. The image forming unit 100 is detached upward between the fixing device 90 fixed to the image forming apparatus body 12 and the rotary developing device 38 through the opening part 158. Further, jam clearing operation for the record medium can also be performed through the opening part 158. When the unit transport guide part 112 of the second record medium feeder 152 is turned on the rotational fulcrum 154 and opened, the opening part 160 is opened on the front side of the image forming apparatus body 12. The developing units 42*a* to 42*d* are detached to the front side of the image forming apparatus body 12 through the opening part 160.

A modified form of the second embodiment according to the invention will now be described with reference to the attached drawings.

Figure 4:
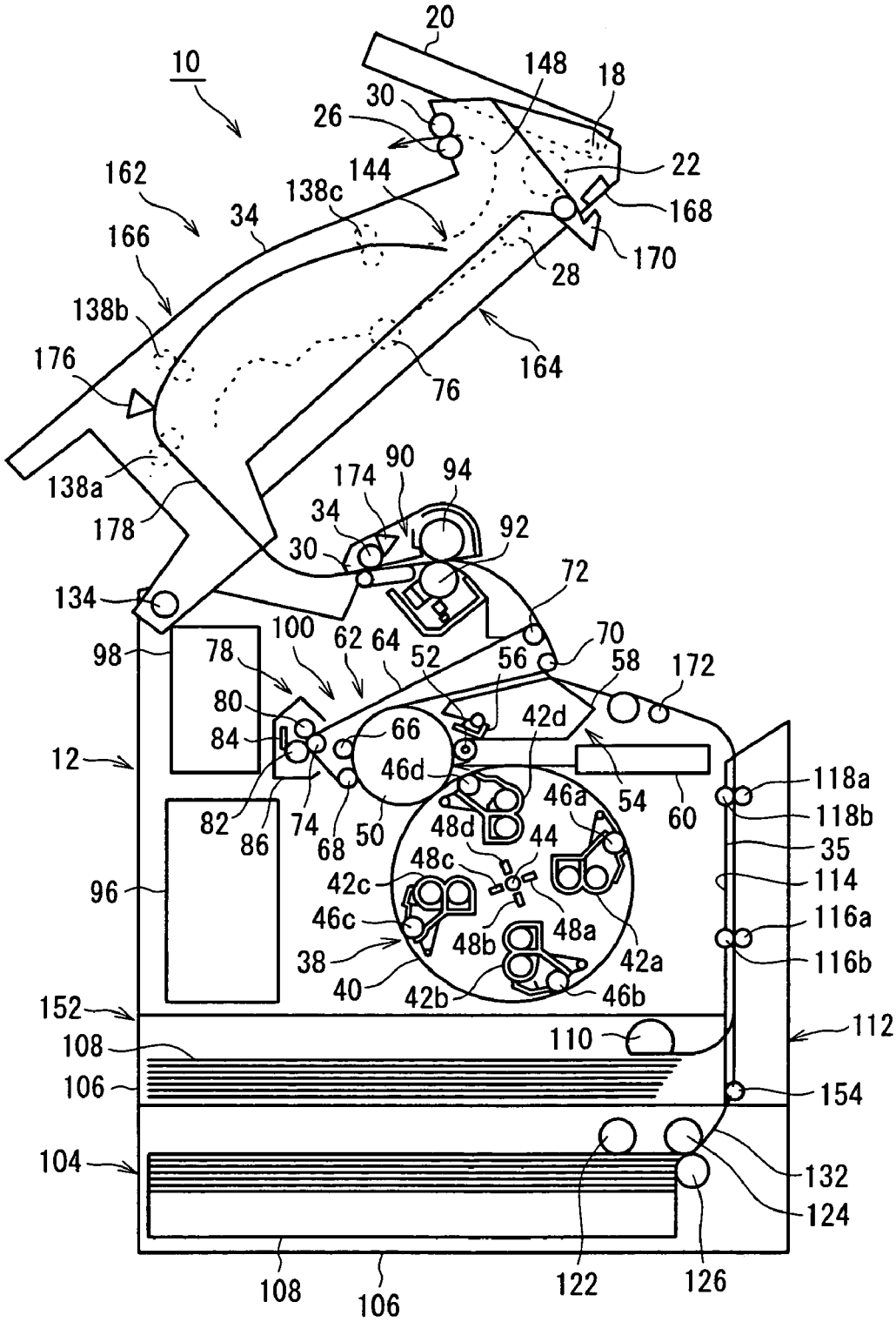
FIG. 4 is a side view showing a modified example of the second embodiment of the invention, which shows the condition where a first opening and closing unit and a second opening and closing unit are opened.
Figure 5:
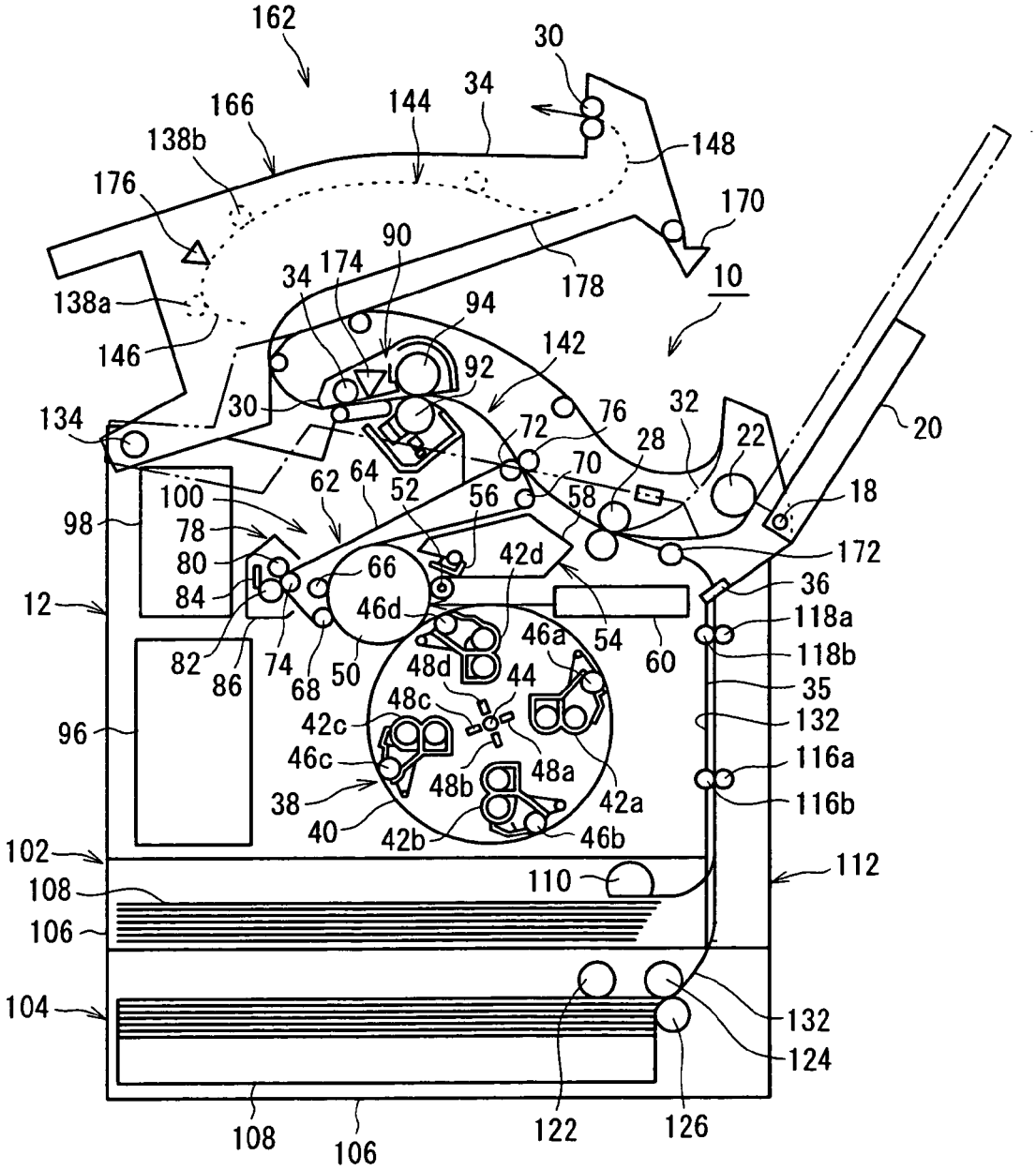
FIG. 5 is a side view showing a modified example of the second embodiment of the invention, which shows the condition where a first opening and closing unit are opened.

FIGS. 4 and 5 show modified forms of the second embodiment according to the invention.

In the modified forms of the second embodiment according to the invention, the substantially same parts as those of the second embodiment of the invention are designated by the same reference numerals.

In the modified forms of the second embodiment according to the invention, an opening and closing part 162 freely turned on a rotational fulcrum 134 is provided on the upper part of the image forming apparatus body 12. The opening and closing part 162 is constituted of a first opening and closing unit 164 and a second opening and closing unit 166 superposed one over the other, which are respectively turned on the rotational fulcrum 134.

The opening and closing part 162 may be removably provided on the image forming apparatus body 12.

In the first opening and closing unit 164, the inside of the lower surface forms a substantially horizontal portion of a first transport path 142 with an image forming apparatus body 12, and the inside of the upper surface and the back (the left in FIGS. 4 and 5) form a second transport path 144 and a first U-turn part 146 with the second opening and closing unit 166. The first opening and closing unit 164 is provided with a first fixing member 168 such as an electromagnetic lock mounted on the lower part thereof on the counter-rotational fulcrum side, thereby fixing the first opening and closing unit 164 and the image forming apparatus body 12 according to the control of a control part 98.

In the second opening and closing unit 166, the inside of the lower surface and the back (the left in FIGS. 4 and 5) form a second transport path 144 and a first U-turn part 146 with the first opening and closing unit 164, and the inside of the front (the right in FIGS. 4 and 5) is provided with a second U-turn part 148. A discharge part 34 is formed on the upper portion of the unit. The second opening and closing unit 166 is provided with a second fixing member 170 such as a latch mounted on the lower part on the counter-rotational fulcrum side, whereby the second fixing member 170 is engaged with a bearer 172 provided on the image forming apparatus body 12 to thereby fix the second opening and closing unit 166 to the image forming apparatus body 12. Further, the first opening and closing unit 164 is provided with a through hole (not shown) passing the second fixing member 170, whereby the second opening and closing unit 166 is fixed to the image forming apparatus body 12 from above the first opening and closing unit 164 to thereby fix the first opening and closing unit 164 to the image forming apparatus body 12.

In the modified form of the second embodiment according to the invention, the interior of the fixing device 90 and the first U-turn part 146 or the second transport path 144 are respectively provided with sensors 174, 176 for detecting the existence/absence of a record medium. On detecting the existence/absence of the record medium, the sensors 174 and 176 output the detection result to the control part 98. In the case where both of the sensors 174, 176 detect the existence of the record medium for more than designated time, for example, as shown in FIG. 4, it is indicated that the record medium 178 is stopped extending into the first transport path 142 and the first U-turn part 146. Accordingly, an operator can remove the record medium 178 stopped extending into the first transport path 142 and the first U-turn part 146 by opening the first opening and closing unit 164 and the second opening and closing unit 166 at the same time in the superimposed state.

Further it will be sufficient that when both of the sensors 174 and 176 detect the existence of the record medium for more than designated time, the control part 98 may control the first fixing member 168 to fix the first opening and closing unit 164 and the image forming apparatus body 12. In this case, since the first opening and closing unit 164 is fixed to the image forming apparatus body 12, the operator, as shown in FIG. 5, opens the second opening and closing unit 166, separates the upper surface side of the first opening and closing unit 164 from the lower surface side of the second opening and closing unit 166, and opens the first U-turn part 146 and the second transport path 144 to remove the record medium 178. That is, the first U-turn part 146 side of the stopped record medium 178 can be put in the state of a free end, so that breakage of the record medium 178 can be prevented. On the other hand, the first fixing member 168 may be controlled by the control part 98 so that when both sensors 174 and 176 detect the absence of the record medium, the first opening unit 164 and the second opening and closing unit 166 are respectively freely turned. Thus, it will be sufficient that according to the detection result of the sensors 174, 176 on the record medium 178, the selected first opening and closing unit 164 or second opening and closing unit 166 may be opened.

Further, it will be sufficient that a lever (not shown) for releasing fixing of the first fixing member 168 is provided in a position to be operated at the time of opening the second opening and closing unit 166, whereby when the second opening and closing unit 166 is opened, the first fixing member 168 is opened.

As described here in above, the image forming part includes an image bearing member and preferably the reversing path is disposed above the image bearing member. Further, the image forming part includes a fixing device and preferably the reversing path is disposed above the fixing device. Accordingly, regardless of disposition of the image bearing member or the fixing device, even if the record medium is transported in the substantially horizontal direction, both-sided printing can be performed.

Further, the image forming apparatus includes an opening part provided on an upper side of the image forming part and an image forming unit at least having an intermediate transfer body, and the image forming unit is preferably attached and detached through the opening part. Accordingly, the consumables in the image forming apparatus can be replaced from the upper side of the image forming apparatus so as to facilitate maintenance for the image forming apparatus.

The image forming apparatus further includes a first unit forming the transport path and the reversing path, and a second unit forming the reversing path with the first unit and provided with a discharge part for discharging the record medium. Preferably the first unit and the second unit are selectively moved. Preferably when the second unit is moved, the first unit is also moved. Further, the image forming apparatus includes a first detecting section that detects whether or not the record medium is in the transport path, a second detecting section that detects whether or not the record medium is in the reversing path, and a control section that controls the movement of the first unit and the second unit according to detection results of the first detecting section and the second detecting section. When the first detecting section and the second detecting section both detect existence of the record medium, preferably the control section controls the first unit and the second unit not to move at the same time. Thus, even if the record medium is stopped extending into the transport path and the reversing path, the reversing path can be opened, whereby breakage of the record medium can be prevented and also the record medium can be removed from the image forming apparatus.

The image forming apparatus further includes a first unit fixing section that fixes the first unit to an image forming apparatus body, and when the first detecting section and the second detecting section both detect the existence of the record medium, preferably the control section controls the first unit fixing section to fix the first unit to the body of the image forming apparatus. Thus, when the record medium is stopped extending into the transport path and the reversing path, the first unit can be prevented from being moved by mistake to break the record medium.

The image forming apparatus further includes a second unit fixing section that fixes the second unit to the image forming apparatus body, and preferably when the second unit fixing section fixes the second unit to the body of the image forming apparatus, the first unit is fixed to the image forming apparatus body. Thus, fixing of the first unit and the second unit can be facilitated.

According to another aspect of the invention, an image forming apparatus includes an image bearing member, plural developing units for developing a latent image written to the image bearing member into a toner image, an intermediate transfer device in which the toner image of the image bearing member is transferred at a primary transfer position and the toner image transferred in the primary transfer position is transported to a secondary transfer position, a record medium feeder for feeding the record medium, a secondary transfer section that secondary-transfers the toner image from the intermediate transfer device to the record medium, a fixing device for fixing the toner image transferred to the record medium, a record medium transport part having the record medium feeder, the secondary transfer section and the fixing device, a transport path disposed above the record medium transport part and substantially parallel to the record medium transport part, a discharge part disposed above the transport path, to which the record medium is discharged, a reversing section disposed above the transport path that reverses the record medium, and a reversing path for transporting the record medium reversed by the reversing section toward the record medium transport part, and the apparatus is characterized in that the record medium transport part is disposed above the image bearing member, the plural developing units and the intermediate transfer device. Accordingly, even in the case of the image forming apparatus having plural developing units, both-sided printing can be performed without any increase in installation area.

Preferably the image forming apparatus further includes an image forming apparatus body at least accommodating the image bearing member, an image forming unit at least having an intermediate transfer body, and an opening and closing part provided on an upper portion of the image forming apparatus body to attach and detach the image forming unit to and from the image forming apparatus body. Thus, the consumables in the image forming apparatus can be replaced from the upper side of the image forming apparatus body by opening the opening and closing part so as to facilitate maintenance for the image forming apparatus.

The opening and closing part is preferably unitized and freely attached and detached to and form the image forming apparatus body. Accordingly, the workspace can be expanded so as to facilitate maintenance for the image forming apparatus.

According to the invention, while the record medium is transported in the substantially horizontal direction to form an image, both-sided printing can be performed.

The entire disclosure of Japanese Patent Application No. 2003-356174 filed on Oct. 16, 2003 including specification, claims, drawings and abstract is incorporated herein by reference in its entirety.

What is claimed is:

1. An image forming apparatus comprising:

an image forming part;

a transport part transporting a record medium to the image forming part and having a substantially horizontal portion; and a reverse path disposed above the transport portion, having a substantially horizontal part and adapted to reverse and return the record medium to an upstream side of the image forming part in the transport path, wherein the apparatus comprises an opening part provided on an upper side of the image forming part and an image forming unit at least having an intermediate transfer body, and the image forming unit is attached and detached through the opening part, and wherein the apparatus further comprises a first unit forming the transport path and the reverse path and a second unit forming the reverse path with the first unit and provided with a discharge part for discharging the record medium, and the first unit and the second unit are selectively moved.

2. The image forming apparatus according to claim 1, wherein when the second unit is moved, the first unit is moved.

3. The image forming apparatus according to claim 1, wherein the apparatus further comprises a first detecting section that detects whether or not the record medium is in the transport path and a second detecting section that detects whether or not the record medium is in the reverse path, and a control section that controls the movement of the first unit and the second unit according to detection results of the first detecting section and the second detecting section, and when both of the first detecting section and the second detecting section detect existence of the record medium, the control section controls the first unit and the second unit not to move at the same time.

4. The image forming apparatus according to claim 3, wherein the apparatus further comprises a first unit fixing section that fixes the first unit to an image forming apparatus body, and when both the first detecting section and the second detecting section detect the existence of the record medium, the control section controls the first unit fixing section to fix the first unit to the body of the image forming apparatus.

5. The image forming apparatus according to claim 4, wherein the apparatus further comprises a second unit fixing section that fixes the second unit to the image forming apparatus body, whereby when the second unit fixing section fixes the second unit to the body of the image forming apparatus, the first unit is fixed to the image forming apparatus body.

6. An image forming apparatus, comprising:

an image bearing member;

a plurality of developing units for developing a latent image written to the image bearing member into a toner image;

an intermediate transfer device in which the toner image of the image bearing member is transferred in a primary transfer position, and the toner image transferred at the primary transfer position is transported to a secondary transfer position;

a record medium feeder that feeds a record medium;

a secondary transfer section that secondary-transfers the toner image from the intermediate transfer device to the record medium;

a fixing device that fixes the toner image transferred to the record medium;

a record medium transport part having the record medium feeder, the secondary transfer section and the fixing device;

a transport path disposed above the record medium transport and substantially parallel to the record medium transport part;

a discharge part disposed above the transport path, to which the record medium is discharged;

a reversing section disposed above the transport path that reverses the record medium; and a reverse path for transporting the record medium reversed by the reversing section toward the record medium transport part, wherein the record medium transport part is disposed above the image bearing member, the plurality of developing units and the intermediate transfer device.

7. The image forming apparatus according to claim 6, wherein the apparatus further comprises an image forming apparatus body at least accommodating the image bearing member and an image forming unit at least having an intermediate transfer body, and an opening and closing part provided on an upper portion of the image forming apparatus body to attach and detach the image forming unit to and from the image forming apparatus body.

8. The image forming apparatus according to claim 7, wherein the opening and closing part is unitized to be freely attached and detached to and from the image forming apparatus body.

* * * * *